United States Patent [19]

Disko

[11] 4,114,224

[45] Sep. 19, 1978

[54] MOP COMPRISING BONDED NONWOVEN FABRIC ABSORPTIVE ELEMENTS

[75] Inventor: Eberhard Disko, Munich, Germany

[73] Assignee: Firma Carl Freudenberg, Weinheim, Germany

[21] Appl. No.: 760,209

[22] Filed: Jan. 17, 1977

[30] Foreign Application Priority Data

| | | | |
|---|---|---|---|
| Apr. 13, 1976 | [ES] | Spain | 14166 |
| Apr. 13, 1976 | [ES] | Spain | 220296[U] |
| Apr. 13, 1976 | [ES] | Spain | 220294[U] |
| Apr. 13, 1976 | [ES] | Spain | 220295[U] |
| Aug. 12, 1976 | [DE] | Fed. Rep. of Germany | 7625260 |

[51] Int. Cl.[2] ..... A47L 13/20

[52] U.S. Cl. ..... 15/229 A; 15/226; 15/229 R

[58] Field of Search ..... 15/97 A, 225, 226, 229, 15/230.13, 230.14, 230.16; 51/334, 392, 393, 400, 404

[56] References Cited

U.S. PATENT DOCUMENTS

| | | | |
|---|---|---|---|
| 1,027,209 | 5/1912 | Margolius | 15/229 AC |
| 2,320,372 | 6/1943 | McCarthy | 15/229 BC |
| 2,514,496 | 7/1950 | Jones et al. | 15/223 |
| 3,395,416 | 8/1968 | Hughes | 15/228 |
| 3,593,359 | 7/1971 | Strauss | 15/229 BP |
| 3,748,682 | 7/1973 | Rhodes | 15/229 R |
| 3,827,099 | 8/1974 | Allaire et al. | 15/229 R |
| 3,965,519 | 6/1976 | Hermann | 15/209 R X |

FOREIGN PATENT DOCUMENTS

| | | | |
|---|---|---|---|
| 162,946 | 9/1933 | Switzerland | 15/229 A |

*Primary Examiner*—Daniel Blum

*Attorney, Agent, or Firm*—Burgess, Dinklage & Sprung

[57] ABSTRACT

In a mop comprising a plurality of absorptive elements, a handle, and means joining said elements to said handle, the improvement wherein said absorptive elements comprise substantially flat strips of bonded nonwoven fabric, said strips ranging in width from about 5 to 60 mm, in length from about 15 to 60 cm and in thickness from about 0.5 to 3 mm. Binder may be printed onto the elements. The elements are flat and thus there is a greater area of contact with the surface being mopped. The elements may be joined into a round or elongate cross section mop by providing the elements with cuts through which a male member projects, the male member locking with a snap fit into a female member to which a mop handle is attached. Projections may be provided in the male and/or female members to immobilize the absorptive elements.

2 Claims, 15 Drawing Figures

FIG. 13.
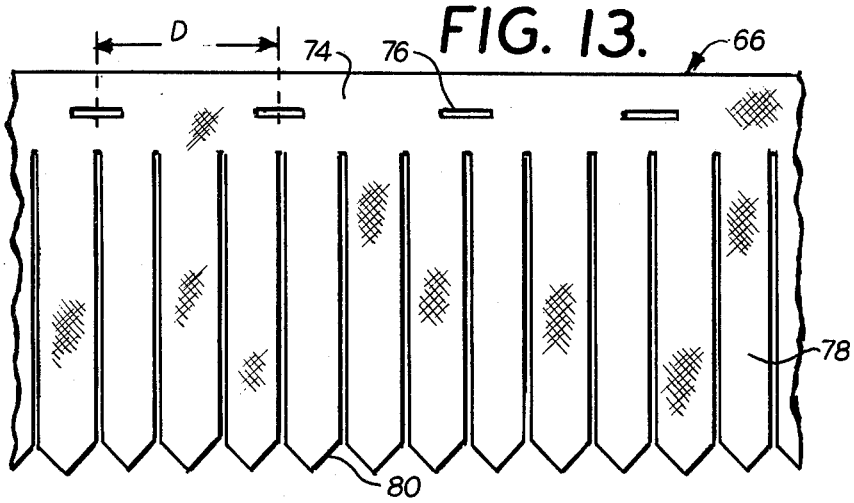
FIG. 12.
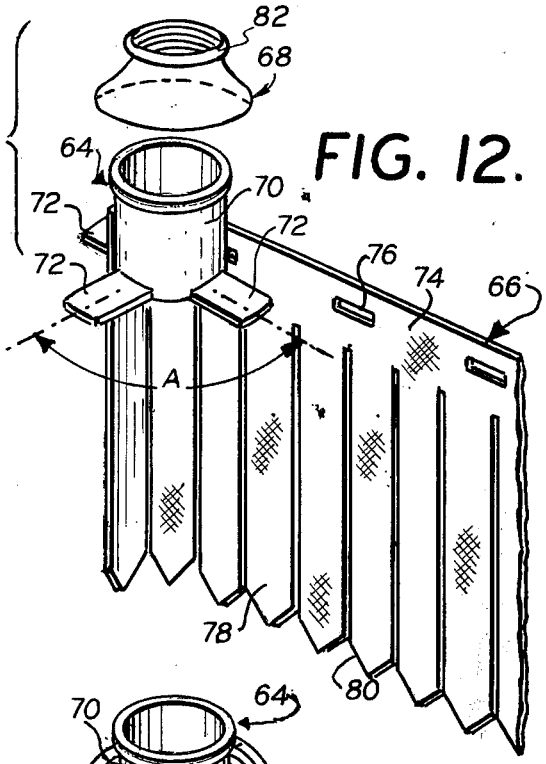
FIG. 15.
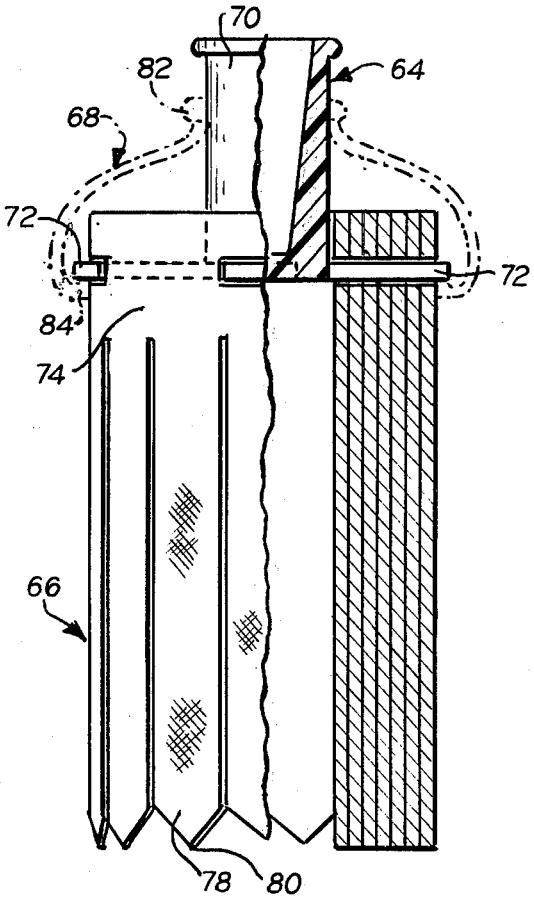
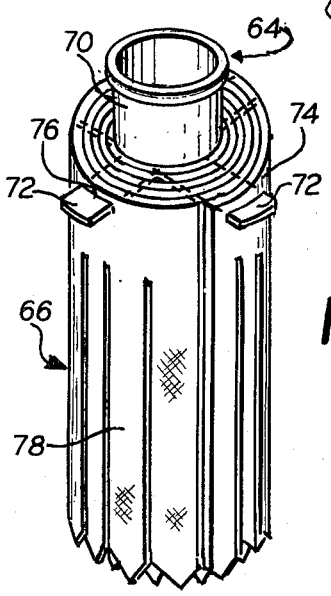
FIG. 14.

MOP COMPRISING BONDED NONWOVEN FABRIC ABSORPTIVE ELEMENTS

The present invention relates to a novel mop and elements thereof.

In mopping it is customary to use mops whose absorptive elements are fiber bundles of relatively large diameter and approximately circular cross-section. When lying on the floor obviously only a relatively small portion of the fiber bundles actually contacts the floor because of the shape. Similar problems are encountered during wringing out of the mop.

It is accordingly an object of the present invention to provide a mop free of these disadvantages, easy to manufacture, assembly and use, and having a novel pleasant appearance.

These and other objects and advantages are realized in accordance with the present invention pursuant to which there is provided a mop comprising a conventional handle or broomstick, a plurality of substantially flat bonded non-woven absorbent elements, and a member joining said elements to one another and to said handle.

The absorbent elements advantageously are from about 5 to 60, preferably about 10 to 40, mm in width and from about 0.5 to 3, and preferably about 1 to 2, mm in thickness. As with conventional mops, their length may vary to give a maximum length from the root of the handle of about 15 to 40 cm and preferably about 15 to 35 cm. Since the absorbent elements may be doubled over in length or otherwise folded back upon themselves, their extended lengths may be multiples of these values.

The absorbent elements are formed of bonded nonwoven fabrics which may range in weight from about 50 to 400 and preferably about 100 to 400 grams per square meter, or a binder-free basis. The fibers may be hydrophilic with appreciable quantities of cotton, rayon, acetate, and the like, but they may even be largely hydrophobic, e.g. nylon, polyester, polyolefin, acrylic, etc., but because of the construction they will still hold large quantities of water and even be fast drying. Advantageously, however, at least about 50% and preferably at least about 75% by weight of the fibers are hydrophilic.

The fibers may be substantially continuous as in tows or spun bond products or they may be staple fibers of conventional lengths, e.g. about 25 to 150 mm, advantageously about 50 to 100 mm. Their deniers can also vary widely from about 1 or less to 50 or more, advantageously from about 2 to 25 and preferably from about 3 to 15. Preferably they are crimped, if synthetic, to facilitate the initial formation of the non-woven web.

The fibers constituting the web may be bonded into a fiber by heating where the fibers are thermoplastic. Bonding may even be effected simultaneously with formation of the web, as in spin bonding. Usually, however, the web will first be formed and binder will subsequently be applied by immersion, spraying, foam impregnation, or other known technique employing known binders which preferably are nonhydrophilic so they will not soften when used in hot soapy water. The binder may be applied in an amount ranging from about 50 to 400, preferably about 100 to 400, grams per square meter and in about 25 to 100%, preferably about 30 to 95%, by weight of the fibers.

The binder may be applied uniformly as in immersion or it may be applied preferentially on the surfaces as by padding or printing since the surfaces require the greatest resistance to abrasion while it is desired to retain the interiors as sponge-like as possible. The binder may even be printed onto the web in a pattern such as a diamond or square and with spacings less than about 20 mm and preferably less than about 10 mm apart to ensure that all surface fibers are held by binder. The binder can be pigmented to give a pattern of colored lines or pictures can even be printed. Even though the binder may reduce the absorptive capacity at the surfaces, by slitting the elements the sides of the elements afford ready access for water to enter the interior of each element which can function like a spongy straw. Because the elements are flat they provide maximum surface area contact with the floor being mopped.

The absorbent elements can be individual with means, such as a hole at one end, for assembly. Alternatively they can be a doublet in length with a hole in the middle. They can be lateral doublets as well, of a double width but slit from one end most of the way to the other end. Conceivably a single piece of bonded nonwoven fabric of circular contour could be formed with radial slits and the whole joined into a circle near the center as in a circular broom.

Joinder can be as by a staple, but may be effected by providing each independent element with one or more holes. A male member is provided with means projecting through the holes and then locks into a female member; the handle can be removably attached to either the male or female member. Refills and/or replacements can be provided for the individual elements or the joined elements with male and female joining members.

Advantageously the joining members are made of plastic which will not rust in water and which can readily be joined by snap-action. Means may be provided in molding to immobilize the joined absorbent elements.

The invention will be further described with reference to the accompanying drawings, wherein:

FIG. 12 is an exploded perspective view of another mop head assembly for attachment to a mop handle;

FIG. 13 is a plan view of the absorption element of FIG. 12;

FIG. 14 is a perspective view showing the joinder of the elements of FIG. 12; and FIG. 15 is a view of said mop in elevation, partially sectioned.

Figure 1:
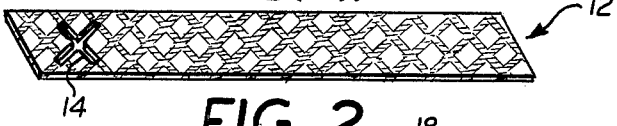
FIG. 1 is a perspective view of an absorbent strip in accordance with the invention.

Referring now more particularly to the drawing, in FIG. 1 there is shown an absorbent element 12 comprising a strip 30 cm long, 10 mm wide and 1 mm thick and cut from a bonded nonwoven fabric comprising by weight 30% of butadiene-acrylonitrile-styrene rubber printed in a green diamond pattern with lines 1 mm wide and 10 mm apart, the binder being heavier at the surfaces than in the interior of the fabric whose fiber content, by weight, is cotton; 50% nylon, 6 denier, 50 mm staple; 25% rayon, 6 denier, 50 mm staple; 25%

The element 12 has a hole or cross-shaped cut 14 for joinder as hereinafter described.

Figure 2:
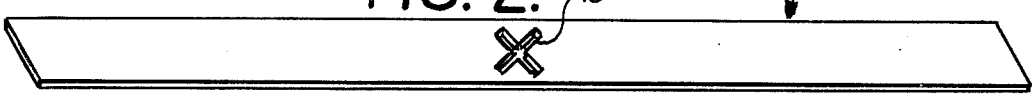
FIG. 2 is a perspective view of an alternate absorbent strip.
Figure 3:
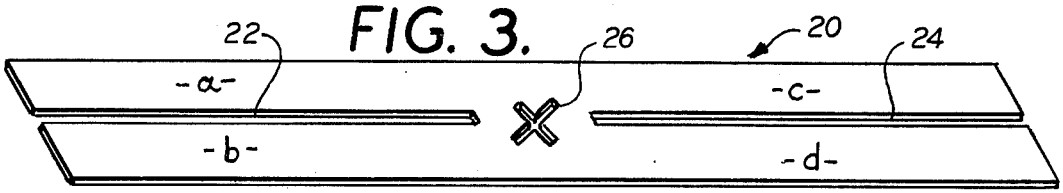
FIG. 3 is a perspective view of still another absorbent strip.

In FIG. 2, the element 16 is of double length with a cut 18 in its middle. In FIG. 3, the element 20 is of double length and width and is provided with two longitudinal slits 22, 24 which subdivide it into joined portions *a, b, c* and *d* and the common center is provided with cut 26.

Figure 4:
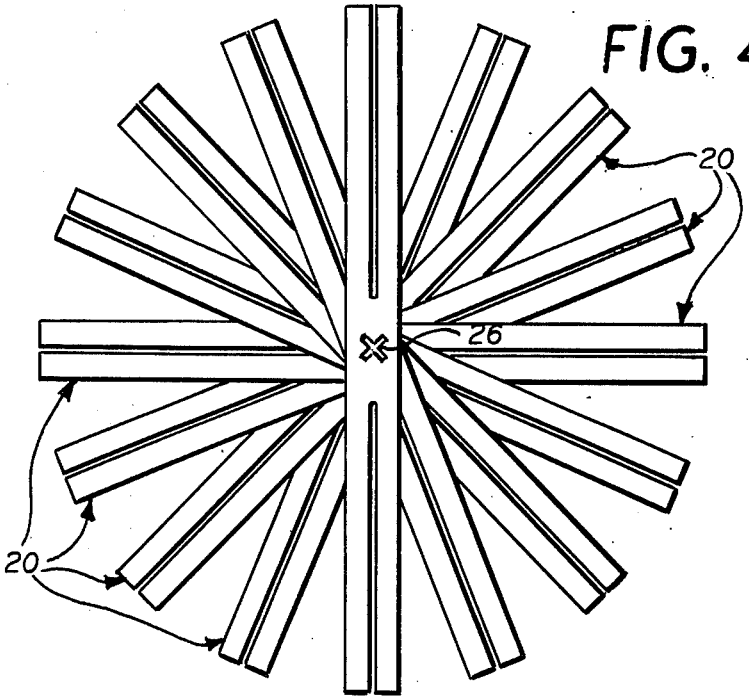
FIG. 4 is a plan view of an array of absorbent strips according to FIG. 3.
Figure 6:
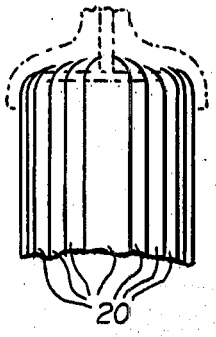
FIG. 6 is a lateral elevation of the array held together with engaging male and female members, shown in phantom with the strips allowed to dangle vertically.
Figure 5:
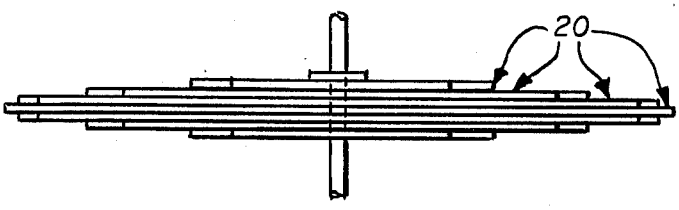
FIG. 5 is a lateral elevation of the array of FIG. 4.
Figure 7:
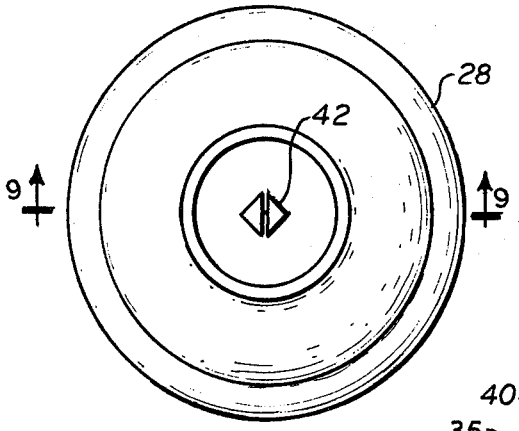
FIG. 7 is a top plan view of the engaged male and female members of FIG. 6 with strips removed.
Figure 8:
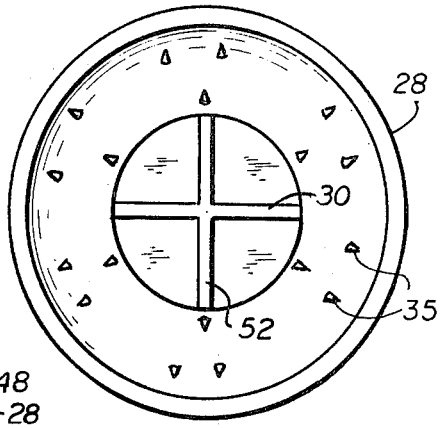
FIG. 8 is a bottom plan view of the structure of FIG. 7.
Figure 9:
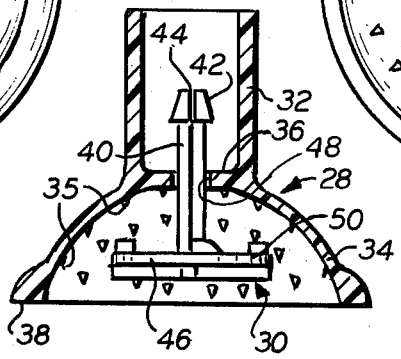
FIG. 9 is a section along the 9—9 of FIG. 7.
Figure 10:
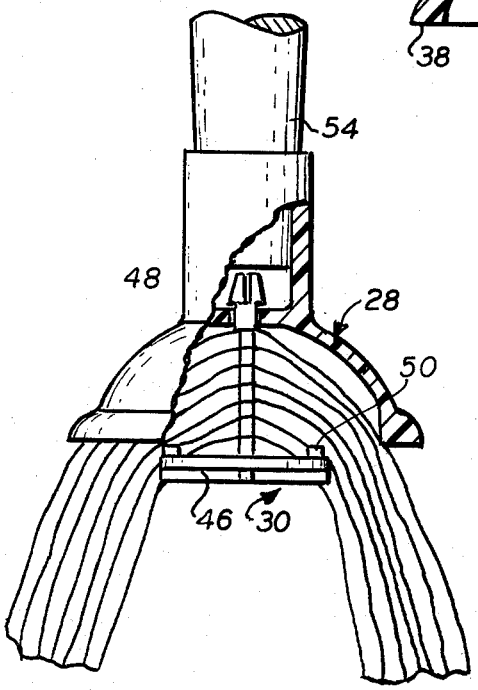
FIG. 10 is a lateral view of a complete mop with portions broken away.

In FIG. 4 there is shown a plurality of elements 20 angularly arranged about a circle with their cuts 26 overlying one another. These are adapted to be held together by a male member projecting through all the cuts 26 as shown in FIGS. 5, 6 and 10.

The means for joining the elements comprises an outer body 28 and an inner body 30, both produced by molding a rigid plastic. The outer body 30 consists of a hollow cylindrical upper part 32 and a dome-shaped lower part 34, an intermediate plane partition 36 being disposed between the two parts. The lower part 34 has prongs 35 on its inner wall and a peripheral reinforcement flange 38.

The inner body 30 consists of a stem or male member 40 which at its upper end has a top 42 with a vertical split 44 and which at its lower end has a plane circular base 46.

The stem 40 in this example is of square cross section, corresponding to the cross section of the central opening 48 in the partition 36 to permit non-turning reciprocal coupling. The base 46 has on its upper surface projections 50 and on its underside ribs 52.

The elements 20 are mounted on the inner body 30, being to this end spindled by the stem 40 which passes through the central openings 26. The assembly formed by the elements 20 and the inner body 30 is coupled to the outer body 28, the stem 40 being to this end forced through the opening 48 in the partition 36, the top 42 being compressed under pressure at its split 44 to permit it to pass through the opening 48. In this way, the mop of strips 20 is firmly held in the support without possibility of becoming separated. A handle 54 is threaded into outer body 28 or forced therein by friction.

When the flexible strips 20 are mounted on the inner body 30, the projections 50 of the base 46 permit the strips to turn without slipping with respect to the body. The prongs 35 of the outer body 30 permit the strips 20 to be fastened.

Figure 11:
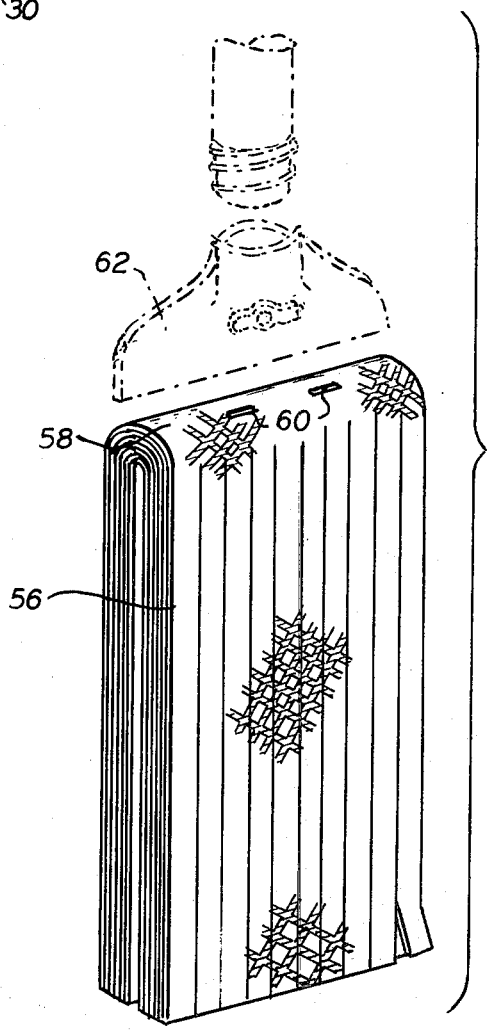
FIG. 11 is an exploded view of the preferred mop including an alternate array of absorbent strips and joining means.

As shown in FIG. 11, in place of an essentially circular mop, a flat mop can be provided by employing a plurality of superposed wide nonwoven sheets 56 which are slit transversely forming elements which project from an unslit spine 58. The stack is stapled at 60, is folded over and in intended to fit a conventional mop handle assembly 62 heretofore employed with string mop refills.

Referring now to the embodiment of FIGS. 12 to 15, in FIG. 12 there is shown a male member 64, an absorption element 66 and a female member 68. The male member 64 is a body of molded plastic forming a hollow cylinder or slightly tapered frustoconical portion 70 that at its lower part has some radial projections 72. These projections 72 are flat with lateral edges that may be parallel or diverging, and may be smooth or provided with reliefs, yet in any case are regularly distributed about the portion 70.

The absorption element 66, as best seen in FIG. 13, is a thin sheet in the shape of an oblong, rectangular narrow strip, the upper part of which has a marginal area 74 provided with some slots or holes 76 in the same longitudinal alignment and regularly distributed in such a manner that the distance D between them corresponds essentially to the arc length A between projections 72 adjacent portion 70. In this example, the male member 64 has four projections 72 which thus are at right angles to one another.

The element 66, with the exception of its upper marginal area 74, is slit to form narrow strips 78, free at the bottom, and which terminate at a point 80.

The mounting of the element 66 on the male member 64 is effected by wrapping its marginal upper area 74 around the male member at the height of its projections 72 in such a manner that these projections are introduced into the slots 76 of element 66 thereby achieving the joinder as shown in FIG. 14. The lower end of a handle (not shown) can be joined to the body 70 of male member 64 by threads, force fit, or the like.

To complete the mop described herein, before or after the handle is attached, there is applied to the male member the female member 68 which is in the form of a molded plastic cap comprising a dome with a central orifice that forms a peripheral projection 82, and which has on its bottom edge a continuous interior rim 84. This cap 68 is mounted by the cylindrical or frustoconical portion 70 of male member 64 passing through its central orifice and by the rim 84 being applied by elastic pressure underneath the projections 72 of the male member 64. Thereby there is effected the complete retention of element 66 and at the same time a better closing of a joint, leaving hidden the upper area of the cloth and its joinder to the male member 64.

In comparison with other existing articles, the mop described herein offers improved conditions for assembling its component elements, and also presents a more pleasing external aspect.

As best seen in FIG. 15, the body 70 of the male member 64 is of non-uniform thickness to provide a lip for locking the cap 68 in place and a taper for force fitting to the handle. As noted, alternately it may be threaded internally at its top to receive a conventional handle.

It will be appreciated that the instant specification and example are set forth by way of illustration and not limitation, and that various modifications and changes may be made without departing from the spirit and scope of the present invention.

What is claimed is:

1. In a mop comprising a plurality of absorptive elements, a handle and means joining said elements to said handle, the improvement wherein said absorptive elements comprise a plurality of superposed flat layers of bonded non-woven fabric of about 1 to 2mm thickness and said non-woven fabric comprises a fibrous web and a binder, the fibrous web comprising at least about 50% by weight of hydrophilic fibers, the binder being present in about 25 to 100% by weight of the fibers, in about 50 to 400 grams per square meter, being printed onto said fabric in a pattern and being present in greater amount adjacent the surfaces than in the interior of said fabric, the layers being joined along a medial spine along which they are adapted to be commonly joined to the handle, the layers each being slit from said spine in both directions to the extremities thereof to form parallel flat strips ranging in width from about 15 to 40mm and in length from about 20 to 60 cm.

2. A mop according to claim 1, wherein the binder is pigmented and printed onto the fabric surfaces in a diamond-pattern.

* * * * *